US008727874B2

(12) United States Patent
Diodato

(10) Patent No.: US 8,727,874 B2
(45) Date of Patent: May 20, 2014

(54) APPARATUS FOR PLAYING GAMBLING GAMES

(76) Inventor: Marcello Diodato, S. Giovanni Teatino (IT)

( * ) Notice: Subject to any disclaimer, the term of this patent is extended or adjusted under 35 U.S.C. 154(b) by 0 days.

(21) Appl. No.: 13/123,891

(22) PCT Filed: May 29, 2009

(86) PCT No.: PCT/IB2009/005833

§ 371 (c)(1),
(2), (4) Date: Jul. 5, 2011

(87) PCT Pub. No.: WO2010/043938

PCT Pub. Date: Apr. 22, 2010

(65) Prior Publication Data

US 2011/0263323 A1 Oct. 27, 2011

(30) Foreign Application Priority Data

Oct. 16, 2008 (IT) ..... MI2008A1840

(51) Int. Cl.
*A63F 9/24* (2006.01)

(52) U.S. Cl.
USPC ..... 463/30; 463/1; 705/14

(58) Field of Classification Search
USPC ..... 463/30, 1; 705/14
See application file for complete search history.

(56) References Cited

U.S. PATENT DOCUMENTS 1,970,731 A * 8/1934 Boggess ..... 273/143 C
3,516,068 A * 6/1970 Howard et al. ..... 345/168
4,995,615 A * 2/1991 Cheng ..... 463/12
5,605,504 A * 2/1997 Huang ..... 463/22
5,653,635 A * 8/1997 Breeding ..... 463/11
6,027,119 A * 2/2000 De Lisle ..... 273/292
7,311,599 B2 * 12/2007 Knapp ..... 463/17
7,357,393 B2 * 4/2008 Finocchio ..... 273/139
7,581,731 B2 * 9/2009 Moody et al. ..... 273/292
7,942,736 B2 * 5/2011 Mincey et al. ..... 463/25
2002/0093136 A1 * 7/2002 Moody ..... 273/139
2003/0048469 A1 * 3/2003 Hanson ..... 358/1.14
2003/0098544 A1 * 5/2003 Tarantino ..... 273/292
2004/0192429 A1 * 9/2004 Moody ..... 463/16
2008/0132314 A1 * 6/2008 Robb et al. ..... 463/17

FOREIGN PATENT DOCUMENTS

WO 2008/033877 3/2008

OTHER PUBLICATIONS

Scarne, "Scarne's Encyclopedia of Card Games", HarperCollins, Copyright 1983, pp. 326-328.*

Diagram Group, The Ultimate Book of Card Games, Sterling Publishging, Copyright 1995, pp. 335-338.*

PCT International Search Report for PCT/IB2009/005833 filed on May 29, 2009 in the name of Marcello Diodato.

PCT Written Opinion for PCT/IB2009/005833 filed on May 29, 2009 in the name of Marcello Diodato.

* cited by examiner

*Primary Examiner* — Pierre E Elisca
(74) *Attorney, Agent, or Firm* — Steinfl & Bruno LLP

(57) ABSTRACT

An apparatus for playing gambling type games having a display device. The apparatus is further capable of producing coupons comprising steps performed by one or more players of the games.

3 Claims, 5 Drawing Sheets

APPARATUS FOR PLAYING GAMBLING GAMES

CROSS REFERENCE TO RELATED APPLICATIONS

The present application is the US national stage of International Application PCT/IB2009/005833 filed on May 29, 2009 which, in turn, claims priority to Italian Patent Application MI2008A001840 filed on Oct. 16, 2008.

The present invention relates to an apparatus for playing gambling games.

It is known that at casinos and similar buildings it is presently possible to take part in gambling games. Typically, a gambling game generally involves a bet by the players (which bet can possibly be submitted to variations during the game), playing of the game and, in the end, distribution of possible wins.

Also presently available on the market are "virtual" versions of gambling games, in which use is provided of electronic and/or electromechanical structures for simulating the different games and enabling the players to amuse themselves without being obliged to physically move and go to the casinos.

Irrespective of the specific conditions under which the game is played, there are fundamental aspects that are to be at the base of the game and exactly impartiality, fairness, honesty and an absolutely necessary randomness component.

In gambling houses it is the staff in charge (comprising the croupiers, for example) that directly gives assurance that the game will be played following the pre-established rules and that no sophistications of any nature are present.

As to the systems of the automated type, there is no available instrument as yet which enables people to verify whether the game results have been someway falsified.

In fact, it is not possible for example to verify whether the machine controlling the game modifies its operation (and therefore the game outcome) as a result of the gamblers' bets or the strategies followed by the players.

Accordingly, it is an aim of the present invention to provide an apparatus for playing gambling games that is reliable and allows the fairness and impartiality of the generated results to be verified.

It is a further aim of the invention to make available an apparatus enabling the gamblers to fully enjoy the game without being obliged to worry about possible interferences in playing the gambling game itself.

The foregoing and further aims are substantially achieved by an apparatus for playing gambling games in accordance with the features recited in the appended claims.

Further features and advantages will become more apparent from the detailed description of a preferred and not exclusive embodiment of the invention.

This description will be taken hereinafter with reference to the accompanying drawings, given by way of non-limiting example, in which:

FIG. 1 diagrammatically shows an apparatus in accordance with the present invention;

FIGS. 2*a* and 2*b* show details of the apparatus seen in FIG. 1;

Figure 1:
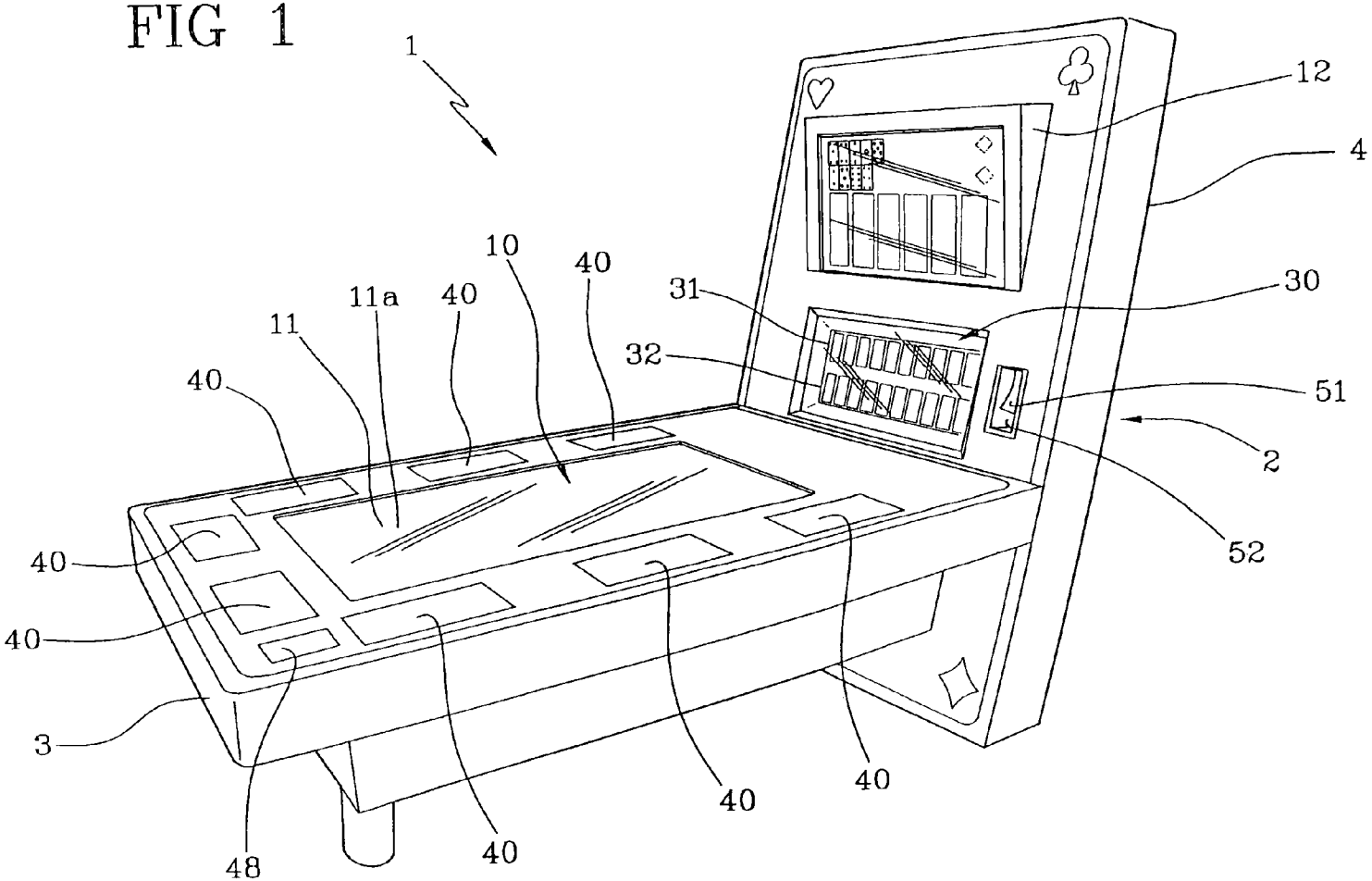

With reference to the figures, an apparatus for playing gambling games in accordance with the invention has been generally identified by reference numeral 1.

It should be recognised that in the present context and the following claims, by gambling game it is intended a game in which at least one gambler or player provided with an initial money amount, can place a bet on an event that is about to occur; the win then depends on the occurrence of such an event, following predetermined proportions.

In place of the aforesaid initial money amount, it is possible to use elements representative of the player's possessions, such as chips or the like.

Typically, considered as gambling games can be the table games for example, such as roulette and some games involving use of cards, such as poker, black-jack, and the so-called "trente et quarante". With reference to the last-mentioned game, an application example of apparatus 1 in accordance with the present invention will be given in the following.

Apparatus 1 first of all comprises a device 10 for displaying a gambling game.

The fact that the displaying device 10 displays the game that is being played practically means that the displaying device 10 shows one or more elements that are used for playing the game itself.

For instance, the displaying device will be able to show a gaming table, some cards (if they are necessary for the gambling game), the amounts of the different players' bets, etc.

Within the scope of the present invention, the game result is established by an electronic control unit 20, as better clarified in the following.

The displaying device 10 can comprise a first monitor or screen 11 for example, on which playing of the game is digitally represented. For instance, the first monitor 11 can represent a gaming surface quite identical with a "physical" gaming table currently utilised.

Advantageously, the first monitor 11 has a surface 11*a* on which the game is displayed; preferably this surface 11*a*, when apparatus 1 is under use conditions, is substantially horizontal, i.e. substantially parallel to the ground.

In the preferred embodiment, apparatus 1 is provided with a supporting structure 2, having a horizontal portion 3 and a transverse, preferably vertical, portion 4. The horizontal portion 3 preferably houses said first monitor 11. Preferably the transverse portion 4 houses a second monitor 12, where the cards used in playing the game can be represented, for example.

Preferably, should said game involve use of cards, apparatus 1 can comprise one or more electromechanical devices 30, interlocked with the electronic control unit 20 (to be better described in the following), and adapted to simulate shuffling and drawing of the cards during the different game steps.

The electromechanical devices 30 are also called "flip cards".

Figure 4:
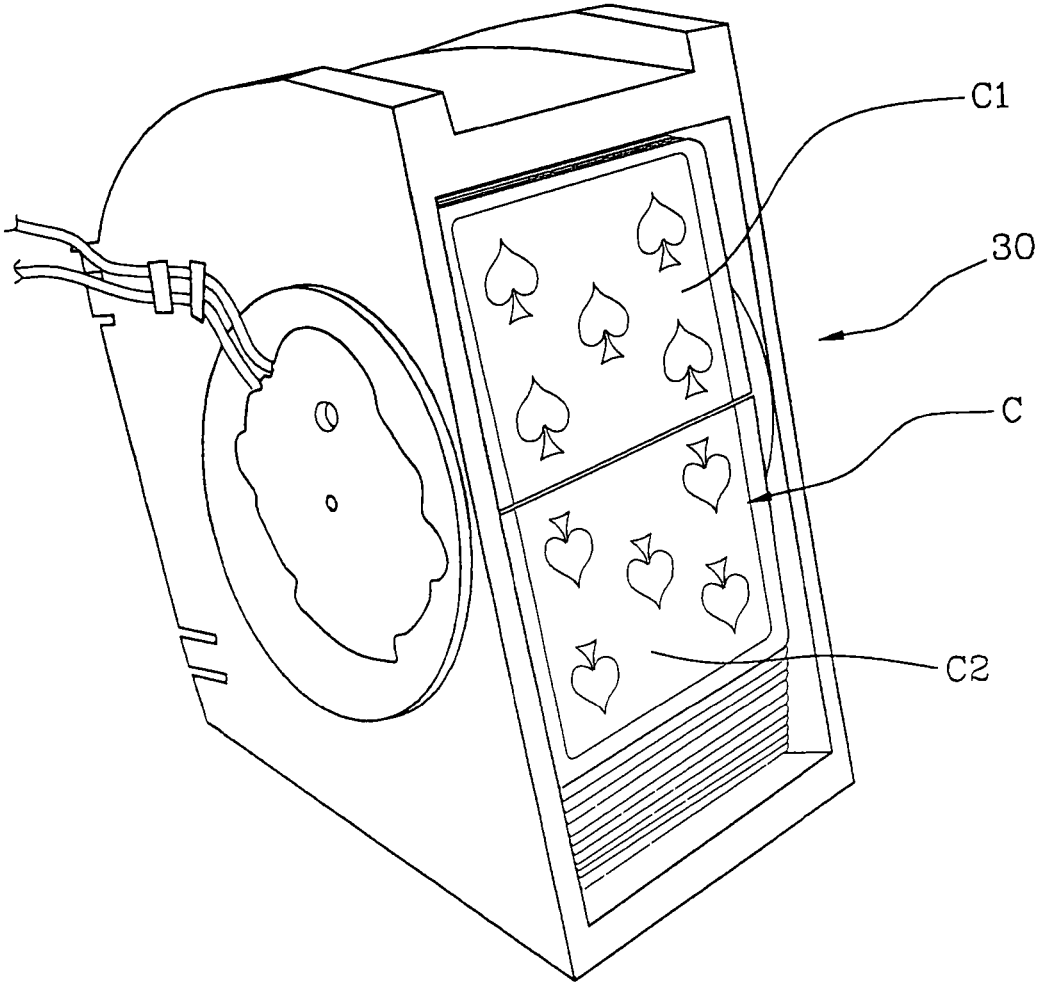
FIG. 4 shows a device being part of the apparatus seen in FIG. 1.

FIG. 4 diagrammatically shows one of these electromechanical devices 30; it is possible to see that each "card" is divided into two portions C1, C2, so that, due to the synchronised movement of the different portions, the card shuffling action can be simulated (also acoustically). When movement is completed, the two halves of the card that has been "drawn" remain at the front on top of all the others.

FIG. 1 by way of example shows a plurality of these electromechanical devices 30 disposed in two parallel rows 31, 32, preferably positioned under the second monitor 12.

Apparatus 1 further comprises one or more play stations 40, each of them being associated with a respective player; the play stations allow the respective players to play the game shown on the displaying device 10. By way of example only, FIG. 1 shows eight play stations 40, each consisting of a console through which the player can place his/her bet, modify it and perform any other operation concerning his/her taking part in the gambling game.

Figure 2A:
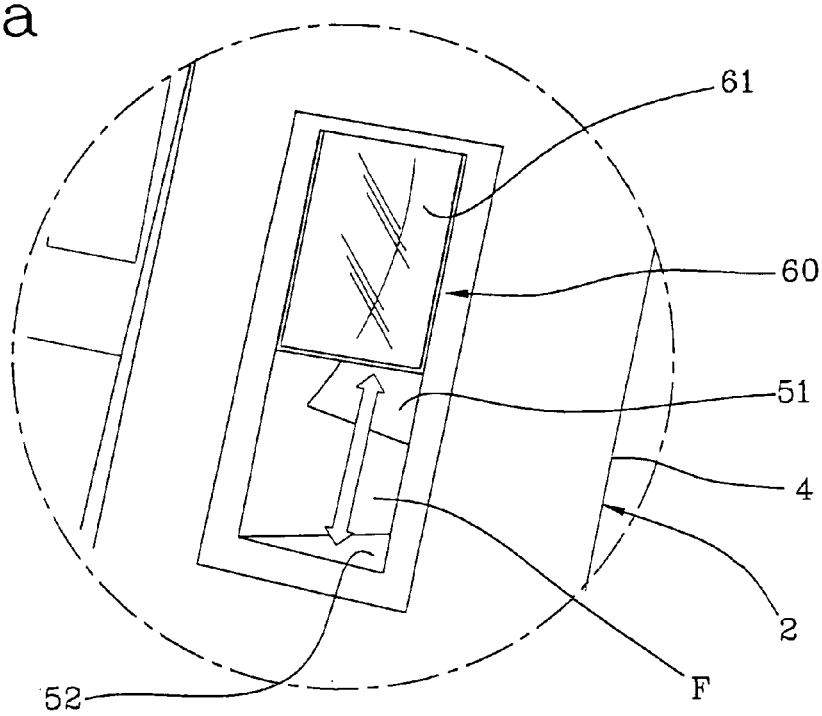
Figure 2B:
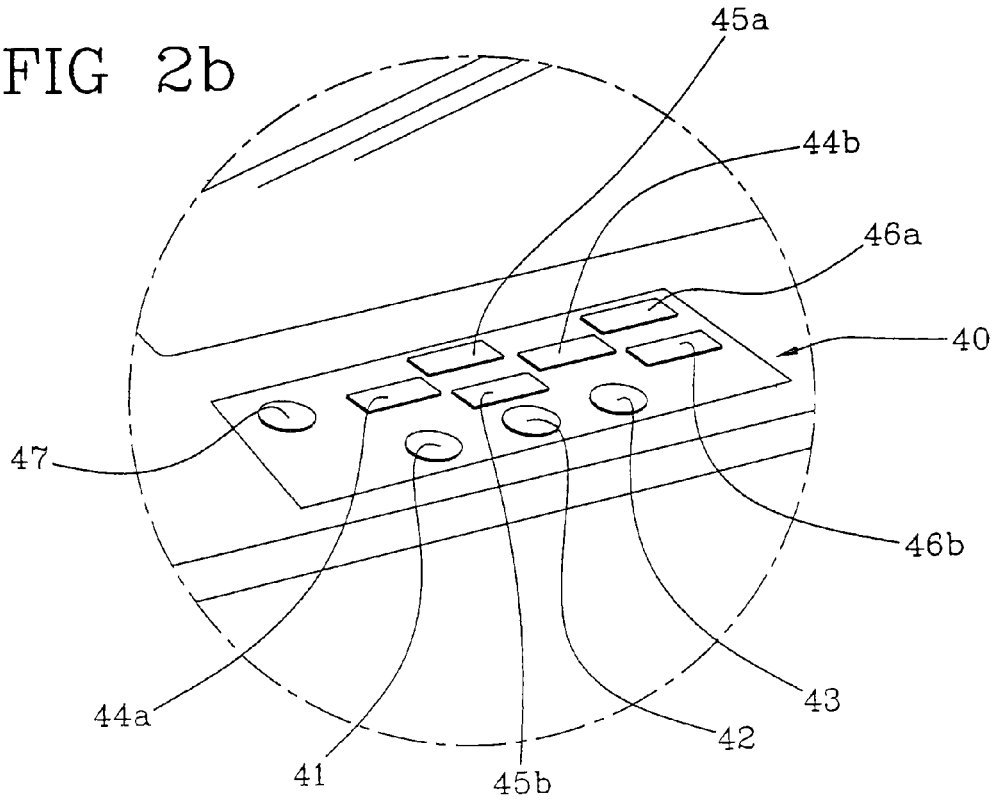

In more detail, FIG. 2*b* shows an example of play station 40 for taking part in the game "trente et quarante". This station comprises: three buttons 41, 42, 43 for multiplying the bet by ten, fifty, one hundred, respectively; two buttons 44*a*, 44*b* for betting on "red" or "black"; two buttons 45*a*, 45*b* for betting on "colour" or "inverse"; two buttons 46*a*, 46*b* for bets of the "après" and "tous après" type; a button 47 for cancelling the operation.

Apparatus 1 may further comprise an auxiliary console to allow an operator to carry out and control management of the crediting operations and winnings of the different players.

In order to simplify wiring between the play stations 40 and the electronic control unit 20 (in particular a first PC 21), an N×M sized matrix system is preferably used in which N is the number of the play stations 40 and M is the number of the operations concerning each player.

By way of example, N can be equal to 8, and M can be equal to 12 (ten operations played through the play station 40 and two operations played through the auxiliary console 48).

Figure 5:
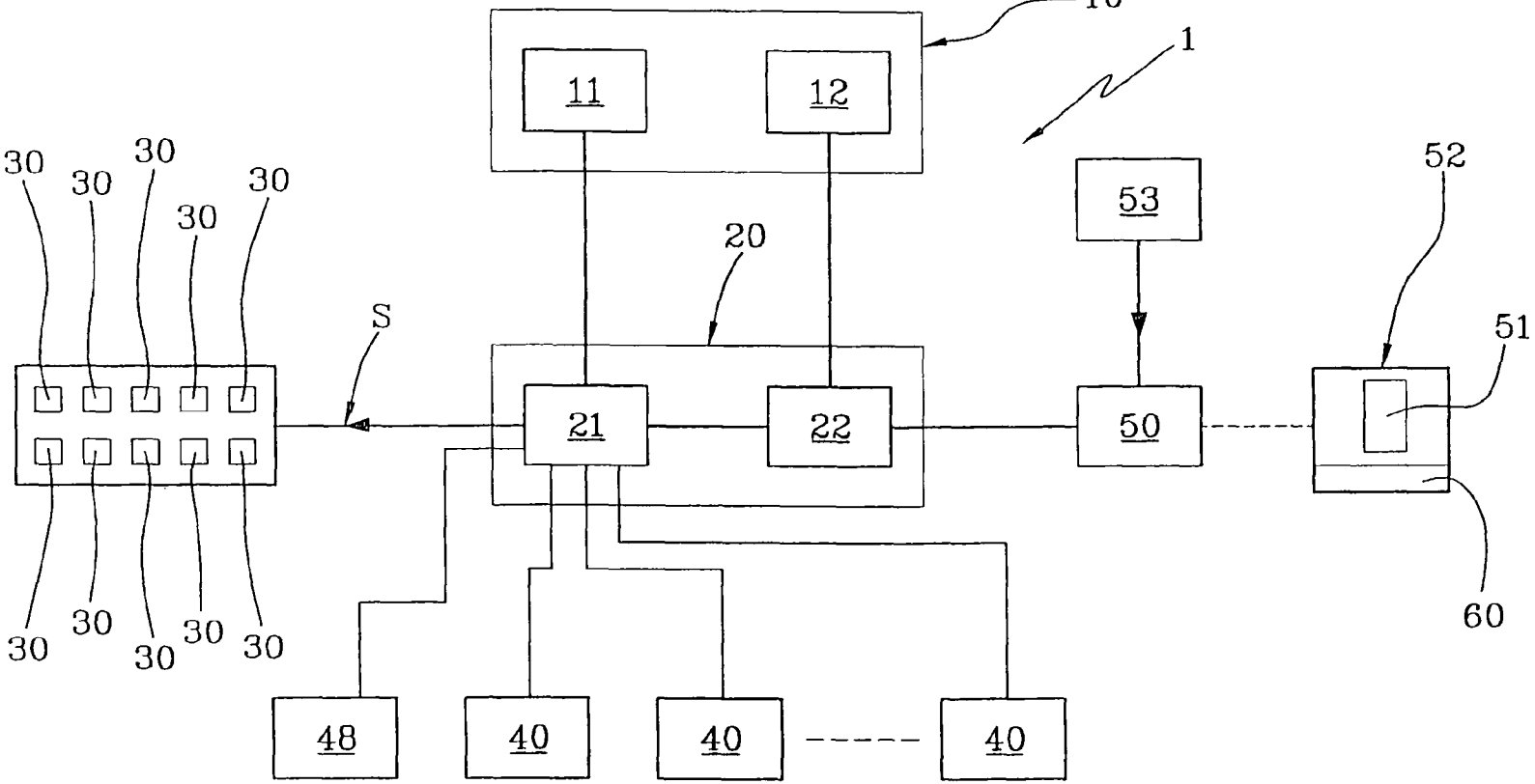
FIG. 5 is a block diagram of an apparatus in accordance with the invention.

As mentioned above, apparatus 1 further comprises an electronic control unit 20 (FIG. 5), operatively associated with the displaying device 10 and the play stations 40, to control playing of the game and display of same.

The electronic control unit 20 may for instance comprise a pair of PC's 21, 22 suitably scheduled for performing the hereinbelow described functions.

Preferably, a first PC 21 is dedicated to the first monitor 11, the electromechanical devices 30 and the play stations 40, while a second PC 22 is dedicated to the second monitor 12 and a dispensing device 50 to be described in the following.

In addition, the electronic control unit 20 is suitably connected to said electromechanical devices 30 for sending them signals S (FIG. 5) representative of the card that must be "drawn" by turns and thus activating the movements adapted to simulate shuffling of the pack of cards.

More particularly, each electromechanical device 30 is associated with a respective board or card, enabling interfacing with the electronic control unit 20.

Advantageously, apparatus 1 further comprises a dispensing device 50 (FIG. 5), interlocked with the electronic control unit 20 for dispensing a coupon 51 reproducing the results of one or more steps of the game.

In particular, the dispensing device 50 is adapted to deliver said coupon 51 before said one or more steps of the game are played by the players.

The dispensing device 50 can for instance comprise a printer, operatively associated with the electronic control unit 20 for carrying out printing on the coupon 51 of the results of the game steps that are still to be played.

Downstream of said printer one or more rollers or other actuating means may be provided, for conveying the coupon 51 to a housing space 52 to be described in the following.

As an alternative to the printer, any other device can be used which is capable of causing data concerning the game results to be reproduced on the coupon 51.

It is also to be noted that coupons 51 can be made of paper or plastic material or any other material suitable for printing or at all events adapted to reproduce data that can be read by the players taking part in the game.

Apparatus 1 can comprise a magazine 53 holding the coupons 51, from which said coupons are fed to the dispensing device 50 for being printed and delivered. This magazine can for example consist of a container in which the coupons are kept ready for use.

Should not the dispensing device be able to directly pick up the coupons from the magazine (due to too great a distance between them, for example), use of suitable conveying means (not shown) is provided for transferring said coupons from the magazine to the dispensing device 50.

Figure 3:
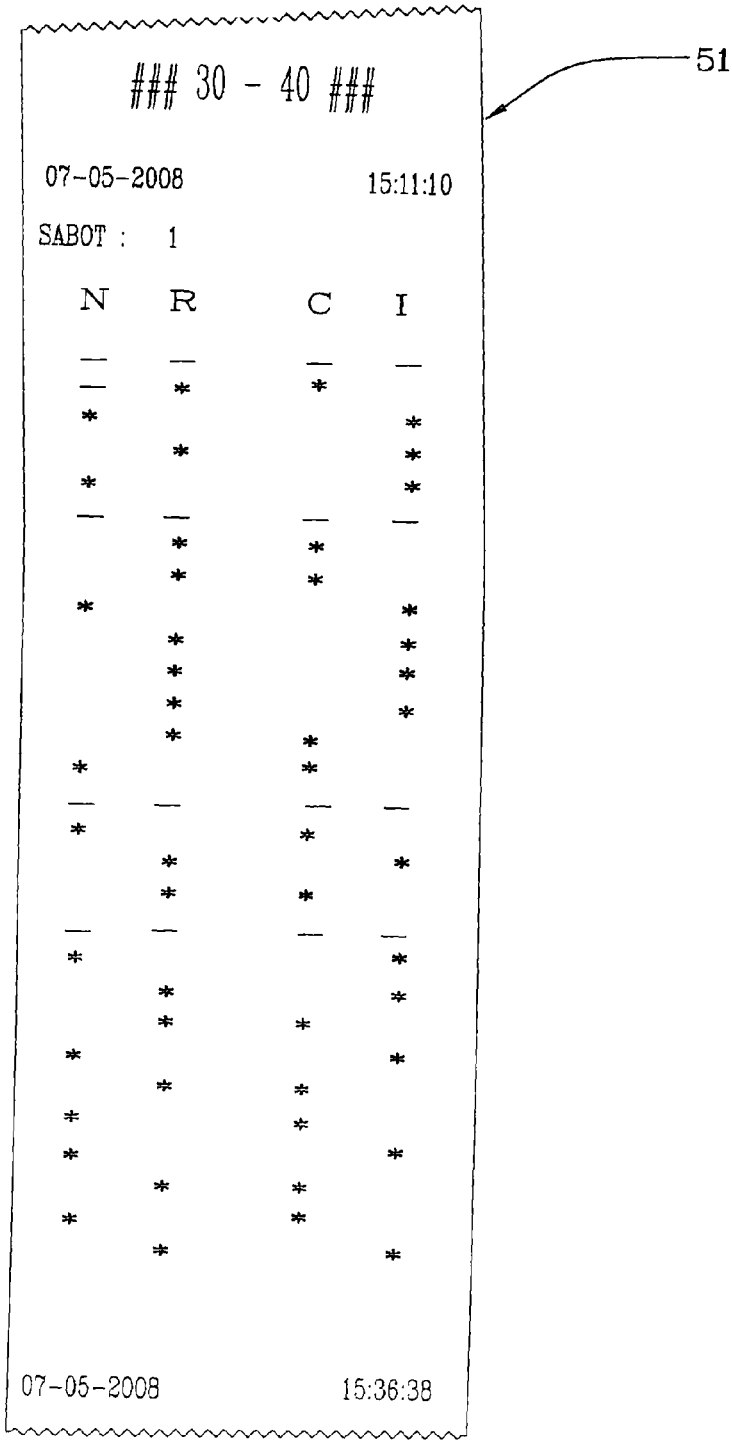
FIG. 3 shows a coupon obtained from the apparatus seen in FIG. 1.

FIG. 3 shows a coupon 51 by way of example, on which the results of a series of steps of the game currently referred to as "thirty and forty" are reproduced.

Preferably, apparatus 1 further comprises means 60 for selective access to the coupon 51; this means 60 can be driven between a first operating condition and a second operating condition. In the first operating condition the selective-access means 60 does not allow the player (or players) to accede to the contents of the coupon 51; however, preferably, the selective-access means 60 enables the player (or players) to verify whether the coupon 51 is present or not.

In other words, before starting the game (or, more generally, before starting one or more steps of the game), the dispensing device 50 delivers the coupon 51; at this point the players can verify the existence of the coupon 51, but they cannot accede to the contents of said coupon 51. For instance, as better clarified in the following, the players are allowed to see the coupon 51 but they are not allowed to read the things reproduced on said coupon 51.

In the second operating condition, on the contrary, the player (or players) is/are allowed to accede to the contents of the coupon 51, i.e. to read the information printed thereon, for example.

Conveniently, the selective-access means 60 is interlocked with the electronic control unit 20 that drives it to the first operating condition while the game steps are being played, whereas it drives said means to the second operating condition at the end of said game steps. Under this situation, the players can check whether the game was played exactly as pre-established (i.e. as printed on the coupon 51), and therefore was not affected by the players' behaviour or bets, for example.

In the preferred embodiment, the selective-access means 60 comprises a window 61 (FIG. 2*a*), in particular made of transparent material, that can be moved between a closed position and an open position. In the closed position, window 61 allows the coupon 51 to be seen but prevents access thereto (practically, it prevents a player from getting hold of the coupon 51 and reading the contents thereof); in the open condition, window 61 allows access to the coupon 51 so that the players can take advantage of that which is printed on the coupon 51 itself.

As shown in FIG. 2*a* by way of example, window 61 can slide on suitable guides formed in the supporting structure 2, so that it can be moved between the first and second positions (arrow "F"). However, window 61 is provided to be moved between the first and second positions also following different types of movements; for instance, window 61 can be made like a tilting door.

Advantageously, apparatus 1 can further comprise locking means (not shown) preventing the selective-access means 60 from being driven from the first to the second operating conditions while the game steps are being carried out and have not yet been completed. In other words, the locking means inhibits the players from reading the contents of the coupon 51 before the game has come to an end, which will enable them to know the result of the game steps before they have been played.

Preferably, the locking means comprising one or more pins for example, are interlocked with said electronic control unit 20 that, through management of the game being played, will send the locking means suitable command signals; in particular, these command signals can comprise an opening signal by which the locking means is unlocked at the end of the game, so as to enable the players to accede to coupon 51.

Preferably, as mentioned above, apparatus 1 is provided with a housing space 52 formed in the supporting structure 2; the housing space is adapted to house the coupon 51 after the same has been delivered by the dispensing device 50.

The selective-access means 60 therefore selectively allows access to the housing space 52 thereby enabling a selective access to the contents of coupon 51.

Advantageously, the dispensing device 50, housing space 52 and selective-access means 60 are such disposed that the coupon 51, after being supplied by the dispensing means 50, is positioned in the housing space 52 in such a manner that its presence can be checked, but it is not possible to accede to the contents of said coupon 51, if the selective-access means 60 is in the first operating condition. For instance, the results of said game steps are only printed on one face of the coupon 51, and said coupon 51 is disposed in the housing space 52 in such a manner that the printed face cannot be seen during playing of the game.

As diagrammatically shown in FIG. 2*b*, the housing space 52 is made of an opaque material and window 61 alone is made of a transparent material; while the game is being played, the coupon 51 is positioned in such a manner that the face on which the results are printed is not turned towards window 61, or at all events cannot be seen through said window 61.

At the end of the game, or at least of the steps the results of which are reproduced on coupon 51, window 61 is shifted and the players can pick up the coupon 51 from the housing space 52, turn it and compare that which is reproduced on the coupon with the true course of the game that has just come to an end.

In the light of the above, the steps that are played during operation of apparatus 1 are the following:

- defining the results of the game, or at least of some game steps: the electronic control unit 20, following predetermined algorithms and preset statistical laws, establishes how the game is to be played and the result of said game; for instance, in a game contemplating use of a pack of cards, the order according to which the cards will be "drawn from the pack" is initially defined, i.e. the succession of cards that, step after step, will be played;
- providing the coupon 51 and delivering it by means of said dispensing device 50;
- simultaneously maintaining the selective-access means 60 in the first operating condition;
- displaying and playing the game, in accordance with that which is established by the electronic control unit 20 and in accordance with what inserted by the players through their play stations 40;
- finishing the game and driving the selective-access means 60 to the second operating condition;

causing the players to accede to coupon 51 thereby verifying whether the game was correctly played.

An example according to which apparatus 1 is applied to the game named "trente et quarante" is hereinafter given.

The game takes place between the bank and the players; the bank is represented by the electronic control unit 20.

Bets can be placed on four events (referred to as "chances"): Red or Black, Colour or Inverse.

The winning events are determined by the score obtained by adding up the values of the cards that will be drawn, and by the colour of the suit of the first card that is drawn.

The gaming table, preferably represented on the first monitor 11, is of a rectangular shape and drawn on the "green baize" is the layout divided into four regions corresponding to Red (Rouge), Black (Noir), Colour (Couleur), Inverse (Inverse).

The card values are defined as follows: the ace is worth 1 point, the three coat cards 10 points, the other cards have their nominal value.

The electronic control unit 20 before the players place their bets determines the result of each hand, establishing whether it is the Red or the Black, and the Colour or the Inverse that will have to win.

FIG. 3 shows a coupon 51 by way of example, in which the results of a series of bets are exhibited: N, R, C, I represent Black (Noir), Red (Rouge), Colour (Couleur), Inverse (Inverse), respectively and the symbols "*" represent the winning chances.

On coupon 51, each row represents one bet and the related combination of winnings.

After the players have placed their bets through the play stations 40, drawing of two card rows is displayed on the second monitor 12 and the electromechanical devices 30.

The first row plays for the Black combination, the underlying one for the Red combination.

The composition of the first row comes to an end when the sum of the card scores overcomes 30 in value.

Then the second row is made up following the same modality.

The winning score will be the smallest one in the two rows; therefore, if the first row has a smaller score, the winning is Black, while if the second row has a smaller score the winning is Red.

In order to establish which is the winning combination.

between Colour or Inverse, the colour of the first card in the upper row is taken into account: Colour is the winning if the colour corresponds to that of the winning row; on the contrary, if the colour of the first card of the first row is different from the winning colour between Red and Black, then Inverse is the winning.

For instance, if the first row reaches 37 points (the first card is a "Hearts", for instance) and the second row reaches 32 points, then the winning is Red (the score of the second row is smaller) and Colour (because the first card of the first row is red, and therefore the same colour as the winning colour).

When the two rows reach the same score, the hand is declared to be null.

Should the reached sum in both rows be 31 ("Un Après"), bets lose half their value.

As to the bet "après", that the player can place by means of button 46*a*, it relates to the fact that, in the following stake the sum of the card values of each row will be equal to 31.

The bet "tous après" (button 46*b*) on the contrary relates to the bet that the sum of the card values of each row will be the same—however not necessarily equal to 31.

The invention achieves important advantages.

First of all, the apparatus according to the invention allows the players to verify the correctness of the game played, so that reliability of the apparatus 1 itself is increased, as well as transparency as regards the different steps that are played before conclusion of the game.

Therefore the apparatus allows the players to fully enjoy the game pleasure without being anxious about possible sophistications or unfair modifications while the game is being played.

The invention claimed is:

1. An apparatus for playing gambling games, comprising:

a displaying device for displaying gambling games;

one or more play stations, each of the one or more play stations associated with a respective player to enable one or more said players to play a game shown on the displaying device;

an electronic control unit operatively associated with said displaying device and said one or more play stations for controlling a course of said game and displaying same;

a dispensing device interlocked with said electronic control unit for delivering a coupon comprising coupon sections for reproducing one or more possible bets of said game and results of said one or more bets of said game before said one or more bets are played by said one or more players, a housing space, configured to host the coupon once the coupon descends into the housing space, the housing space being defined by two walls each having a wall extension larger than a thickness of the coupon, thus allowing the coupon to curve in a direction different from a descent direction by virtue of said wall extension, the two walls being separated by a wall distance sized to prevent rotation of the coupon on itself, and a window for acceding to said coupon, the window closing said housing space and being drivable between a first condition and a second condition, wherein the first condition prevents said one or more players from acceding to the contents of said coupon while enabling said one or more players to verify presence of said coupon, and the second condition allows said one or more players to accede to the contents of said coupon, wherein said electronic control unit is connected to said window for driving said window to the first condition while said game is being played, and for driving said window to the second condition when said game ends, and wherein said window allows said one or more players to see said coupon when the window is in said first condition.

2. The apparatus according to claim 1, further comprising one or more electromechanical devices interlocked with said electronic control unit, and adapted to simulate shuffling and drawing of cards during said game.

3. The apparatus of claim 1, wherein said one or more bets are bets of red, black, color and inverse represented as a two-dimensional matrix on the coupon, wherein said bets are represented in horizontal sections on the coupon and said red, black, color and inverse are represented in vertical sections of the coupon.

* * * * *